US007644819B2

(12) United States Patent
Gill et al.

(10) Patent No.: US 7,644,819 B2
(45) Date of Patent: Jan. 12, 2010

(54) APPARATUS FOR SECURE TRANSPORT OF CONTAINERS

(75) Inventors: Martin Gill, Coquitlam (CA); Douglas Solaczek, Coquitlam (CA)

(73) Assignee: Genie Carriers Ltd., Port Coquitlam, British Columbia (CA)

( * ) Notice: Subject to any disclaimer, the term of this patent is extended or adjusted under 35 U.S.C. 154(b) by 362 days.

(21) Appl. No.: 11/747,170

(22) Filed: May 10, 2007

(65) Prior Publication Data

US 2008/0277301 A1 Nov. 13, 2008

(51) Int. Cl.
*B65D 85/20* (2006.01)

(52) U.S. Cl. ..... 206/446; 206/564

(58) Field of Classification Search ..... 206/446, 206/389, 486, 557, 559, 562, 563, 564, 565; 211/74; D9/455; 248/128, 176, 176.1, 346.01, 248/346.07, 346.11, 349.1, 346.2–346.5, 248/912

See application file for complete search history.

(56) References Cited

U.S. PATENT DOCUMENTS 3,884,440 A * 5/1975 Rowley et al. ..... 248/146
4,932,621 A 6/1990 Kowk
5,370,245 A 12/1994 Tersch et al.
5,975,342 A 11/1999 Bradeen et al.
6,119,876 A * 9/2000 Lacourse ..... 211/74
6,302,291 B1 10/2001 McCleerey
6,386,559 B1 5/2002 Souza
6,932,449 B2 * 8/2005 Collins et al. ..... 211/85.4
D523,518 S 6/2006 Moldenhauer
7,131,618 B2 11/2006 Berry et al.
2007/0108145 A1 * 5/2007 Milardo et al. ..... 211/74

OTHER PUBLICATIONS

Printout TankBuddy™ website, www.tankbuddy.com, accessed on Feb. 6, 2007.

* cited by examiner

*Primary Examiner*—J. Gregory Pickett
(74) *Attorney, Agent, or Firm*—Oyen Wiggs Green & Mutala LLP

(57) ABSTRACT

An apparatus comprising a base defining a recess shaped to accommodate a bottom of a tank, a pair of side walls extending upwardly from the base, and a pair of end walls extending upwardly from the base. Each side wall defines an indentation on the inner surface thereof shaped to conform to an outer surface of the tank when the bottom of the tank in the recess. One of the end walls defines a notch shaped to accommodate a neck of a bottle lying on a side thereof between the side walls. The apparatus may be used to transport one of the tank and the bottle at a time.

13 Claims, 5 Drawing Sheets

APPARATUS FOR SECURE TRANSPORT OF CONTAINERS

TECHNICAL FIELD

The invention relates to transportation of containers. In particular, certain embodiments provide apparatus for securely transporting containers filled with fluids.

BACKGROUND

Tanks filled with propane or other flammable gases are often sold to individual consumers for use with barbeques or the like. While such tanks are typically labeled with warnings regarding proper transportation, some consumers may not follow such warnings, and simply transport the tanks on the seat or floor of their vehicle. Improper transportation of propane tanks and the like increases the risk of fire, explosion, or other accidents.

Bottles for water coolers may also present transportation challenges for consumers. Such water cooler bottles may be heavy, and subject to tipping and/or rolling when transported in a vehicle without being properly secured. Unsecured water cooler bottles may cause damage to vehicles or injury to occupants when transported.

The inventors have recognized various needs which are currently not satisfied, including needs for apparatus which may be used to securely transport propane tanks and water cooler bottles.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an apparatus comprising a base defining a recess shaped to accommodate a bottom of a tank, a pair of side walls extending upwardly from the base, and a pair of end walls extending upwardly from the base. Each side wall defines an indentation on the inner surface thereof shaped to conform to an outer surface of the tank when the bottom of the tank in the recess. One of the end walls defines a notch shaped to accommodate a neck of a bottle lying on a side thereof between the side walls. The apparatus may be used to transport one of the tank and the bottle at a time.

Further aspects of the invention and features of specific embodiments of the invention are described below.

BRIEF DESCRIPTION OF DRAWINGS

In drawings which illustrate non-limiting embodiments of the invention.

DESCRIPTION

Figure 1:
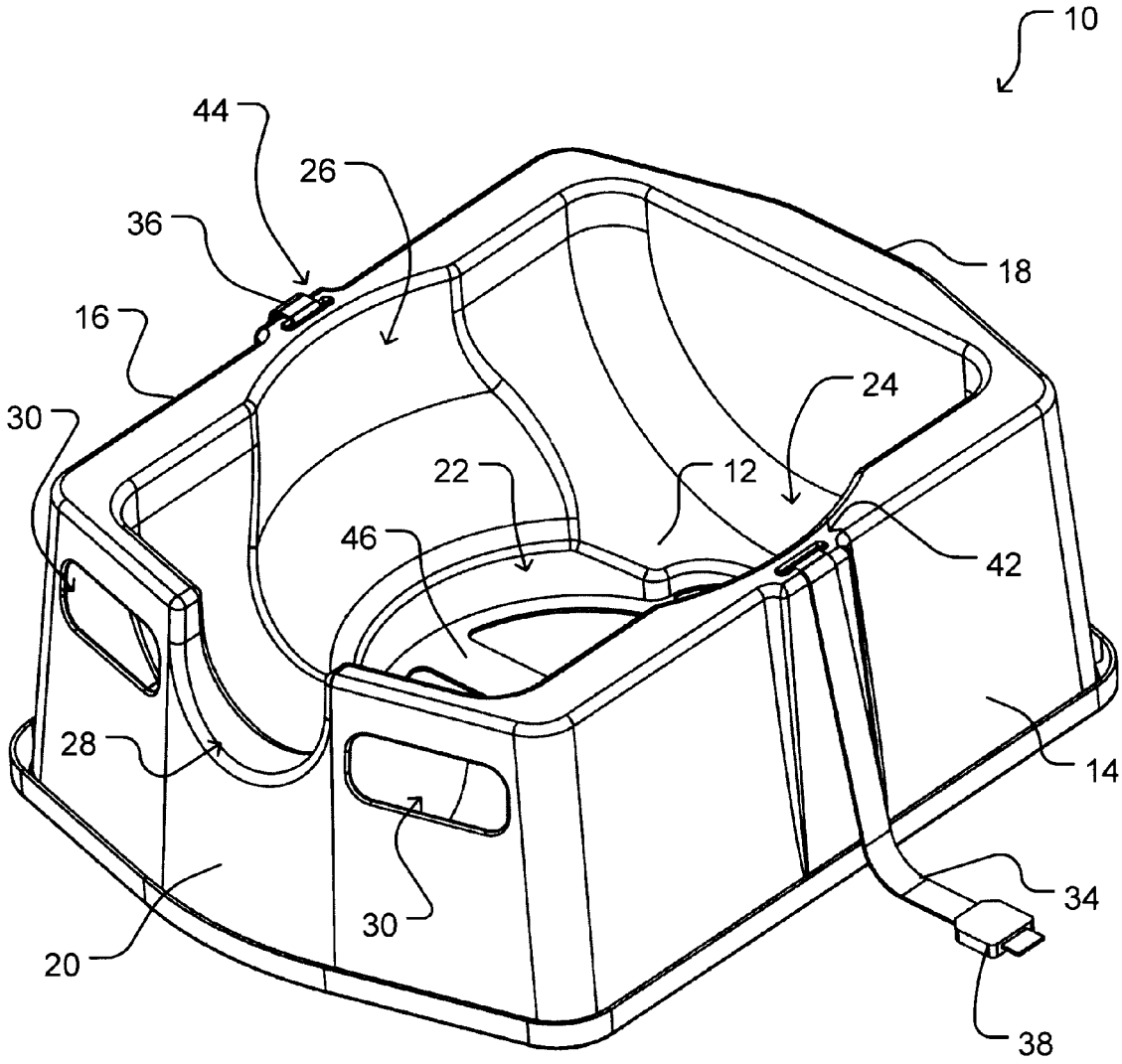
FIG. 1 shows an apparatus for secure transport of containers according to one embodiment of the invention.
Figure 2:
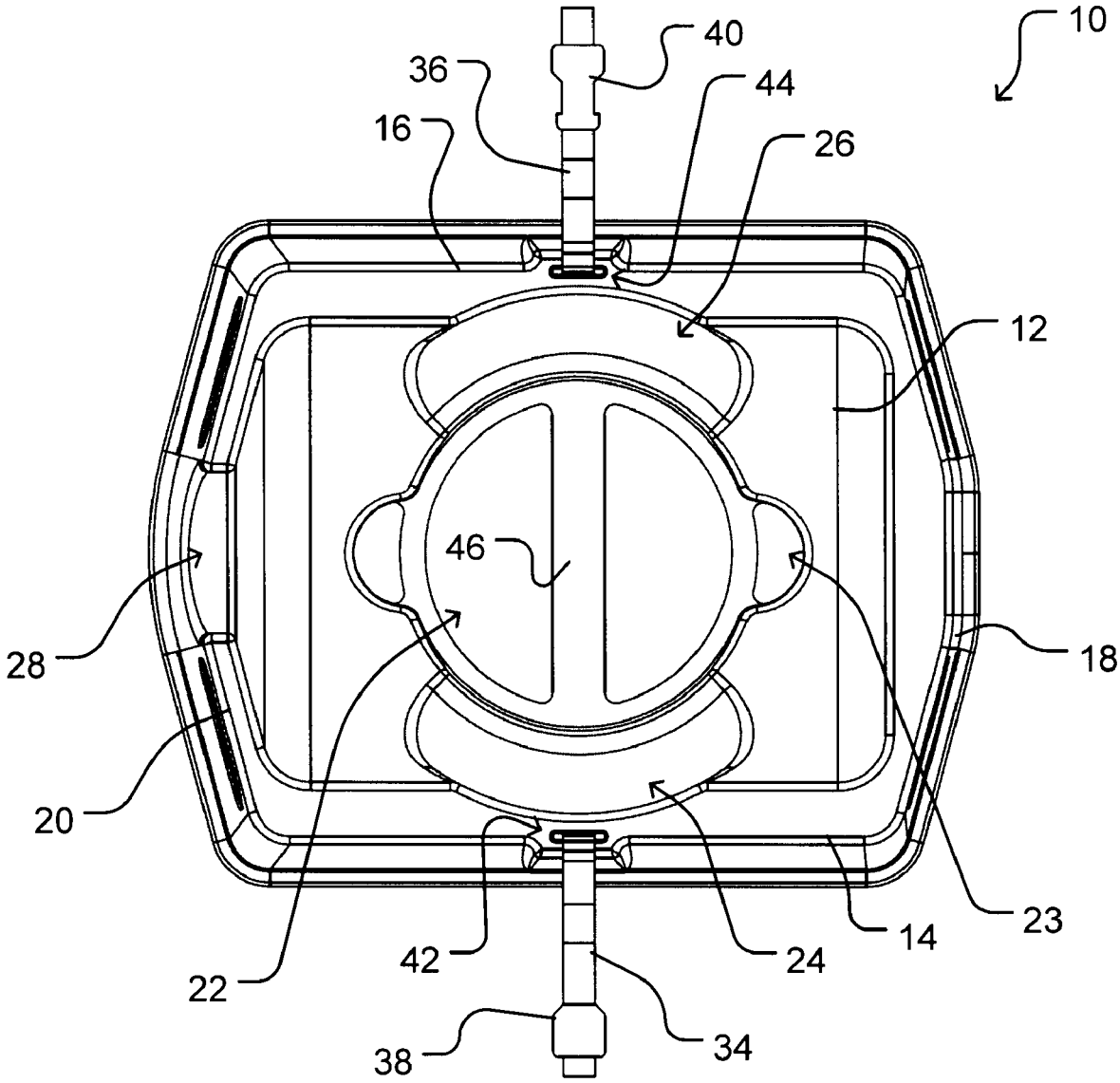
FIG. 2 is a top view of the apparatus of FIG. 1.
Figure 3:
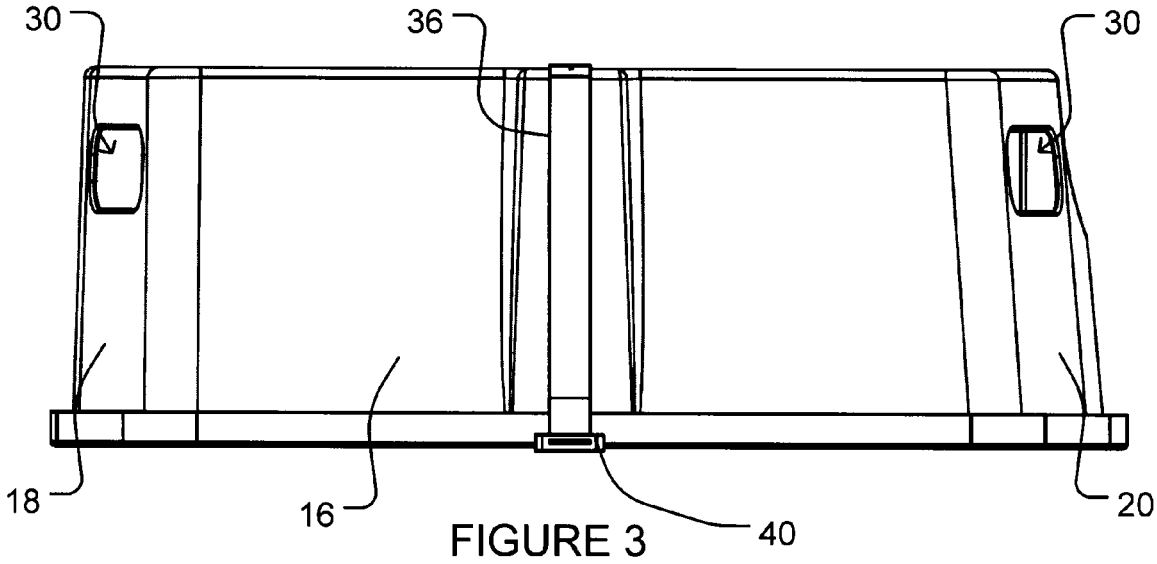
FIG. 3 is a side view of the apparatus of FIG. 1.
Figure 4:
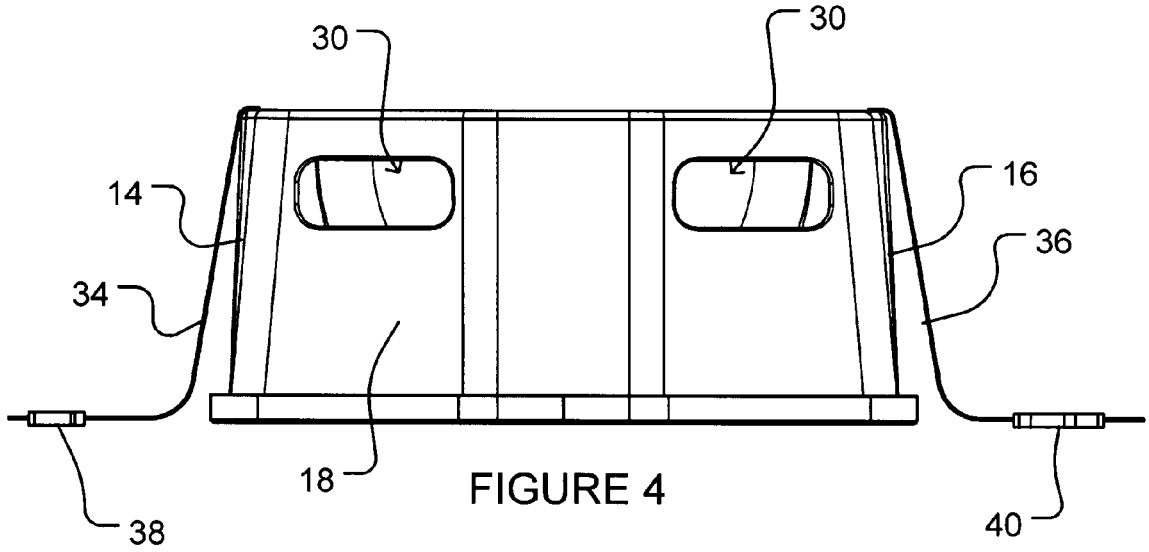
FIG. 4 is an end view of the apparatus of FIG. 1.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Some embodiments of the invention provide a single apparatus which can be used in transportation of either a standard propane tank or a standard five gallon water cooler bottle. This description and the accompanying Figures describe a non-limiting example of one such embodiment. It is to be understood that different embodiments of the invention could be used in transportation of different containers.

FIGS. 1 to 4 show an apparatus 10 according to one embodiment of the invention. Apparatus 10 comprises a base 12. A pair of opposed side walls 14 and 16, and a pair of opposed end walls 18 and 20 extend upwardly from base 12. Side walls 14 and 16 and end walls 18 and 20 may extend upwardly by a distance sufficient to prevent a tank or bottle from tipping out of apparatus 10. In some embodiments, a sufficient distance may be approximately 45% of the height of a standard propane bottle or approximately ⅓ of the overall height of a standard propane tank, (propane tanks typically comprise a bottle with a valve attached to the top thereof, having a cage handle around the valve), or may be at least 60% of the diameter of a standard five gallon water cooler bottle.

In some embodiments, base 12, side walls 14 and 16 and end walls 18 and 20 may be integrally formed, for example, by injection molding or the like. In some embodiments, side walls 14 and 16 and end walls 18 and 20 may be hollow and open along the bottoms thereof, such that the apparatus may be stacked in a nesting fashion.

Base 12 defines a recess 22 therein. Recess 22 is shaped to accommodate the bottom of a tank. In the illustrated embodiment, recess 22 is generally cylindrical in shape, to accommodate the bottom of a standard propane tank. Base 12 may also define one or more grip pad areas 23 (see FIG. 2). Grip pad areas 23 may be configured to contact a surface upon which apparatus 10 is resting, to provide friction between apparatus 10 and the surface. Grip pad areas 23 may be positioned adjacent to recess 22.

Side walls 14 and 16 respectively define indentations 24 and 26 on the inner surfaces thereof. Indentations 24 and 26 are shaped to conform to the outer surface of a standard propane tank sitting in recess 22. Side walls 14 and 16 are spaced apart by a distance insufficient to permit a standard propane tank from being placed on its side therebetween. The configuration of side walls 14 and 16 and indentations 24 and 26 is such that a propane tank may only be placed in an upright position with its bottom in recess 22, as shown in FIG. 5, such that a user is prevented from improperly inserting a propane tank into apparatus 10.

End wall 20 defines a notch 28 therein. Notch 28 is shaped to accommodate the neck of a standard five gallon water cooler bottle lying on its side on base 12. End walls 18 and 20 may be spaced apart such that a standard five gallon water cooler bottle lying on its side on base 12 fits snugly therebetween, with the neck of the bottle extending out of notch 28, as shown in FIG. 6.

In the illustrated embodiment, handles are provided by apertures 30 defined in end walls 18 and 20. Alternatively, handles could be provided by apertures in side walls 14 and 16, by protrusions extending outwardly from side walls 14 and 16 or end walls 18 and 20, or by separate elements attached to 25 apparatus 10. Handles facilitate lifting of apparatus 10, but are not required in all embodiments.

Figure 5:
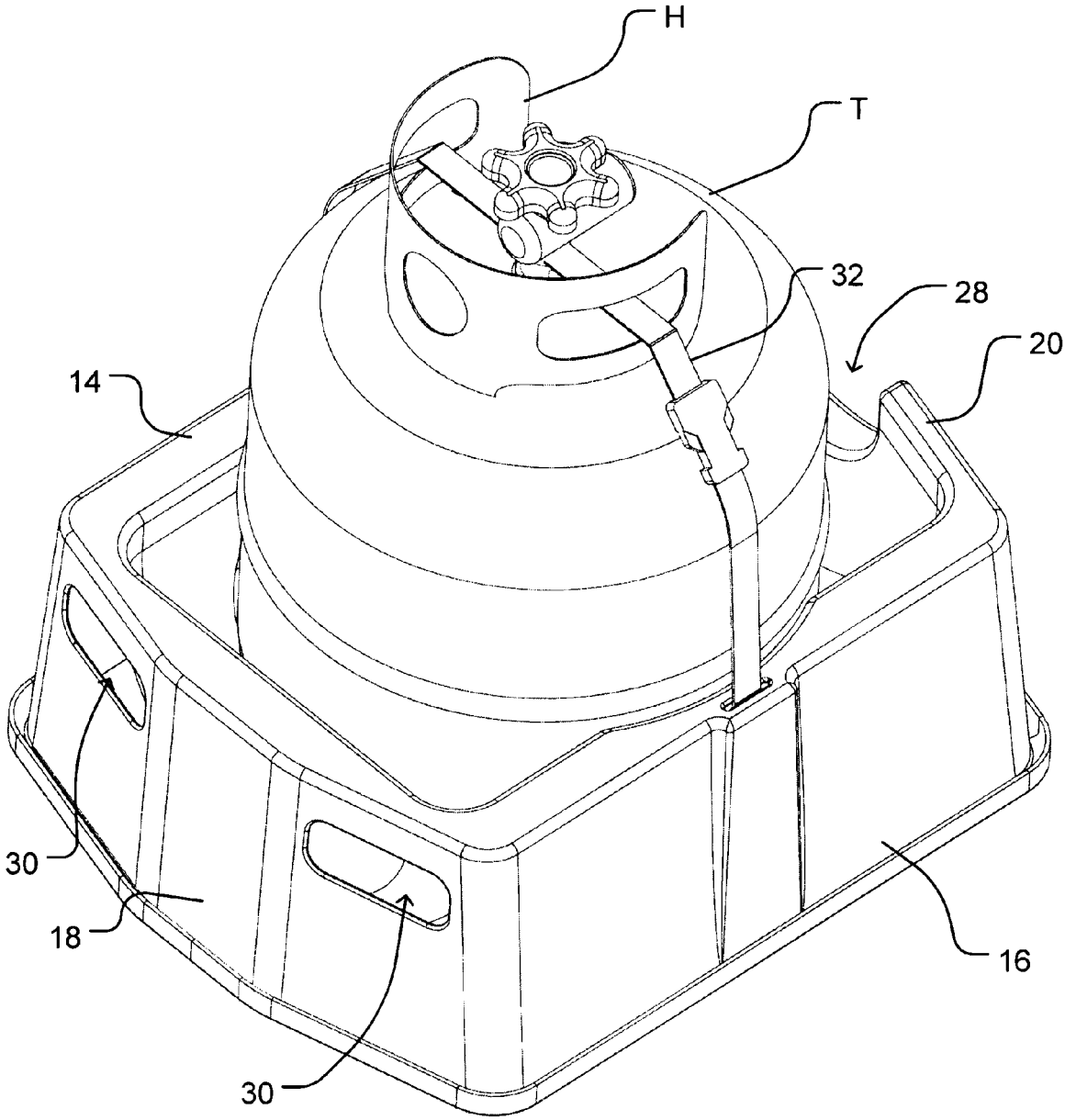
FIG. 5 shows a propane tank secured by the apparatus of FIG. 1.
Figure 6:
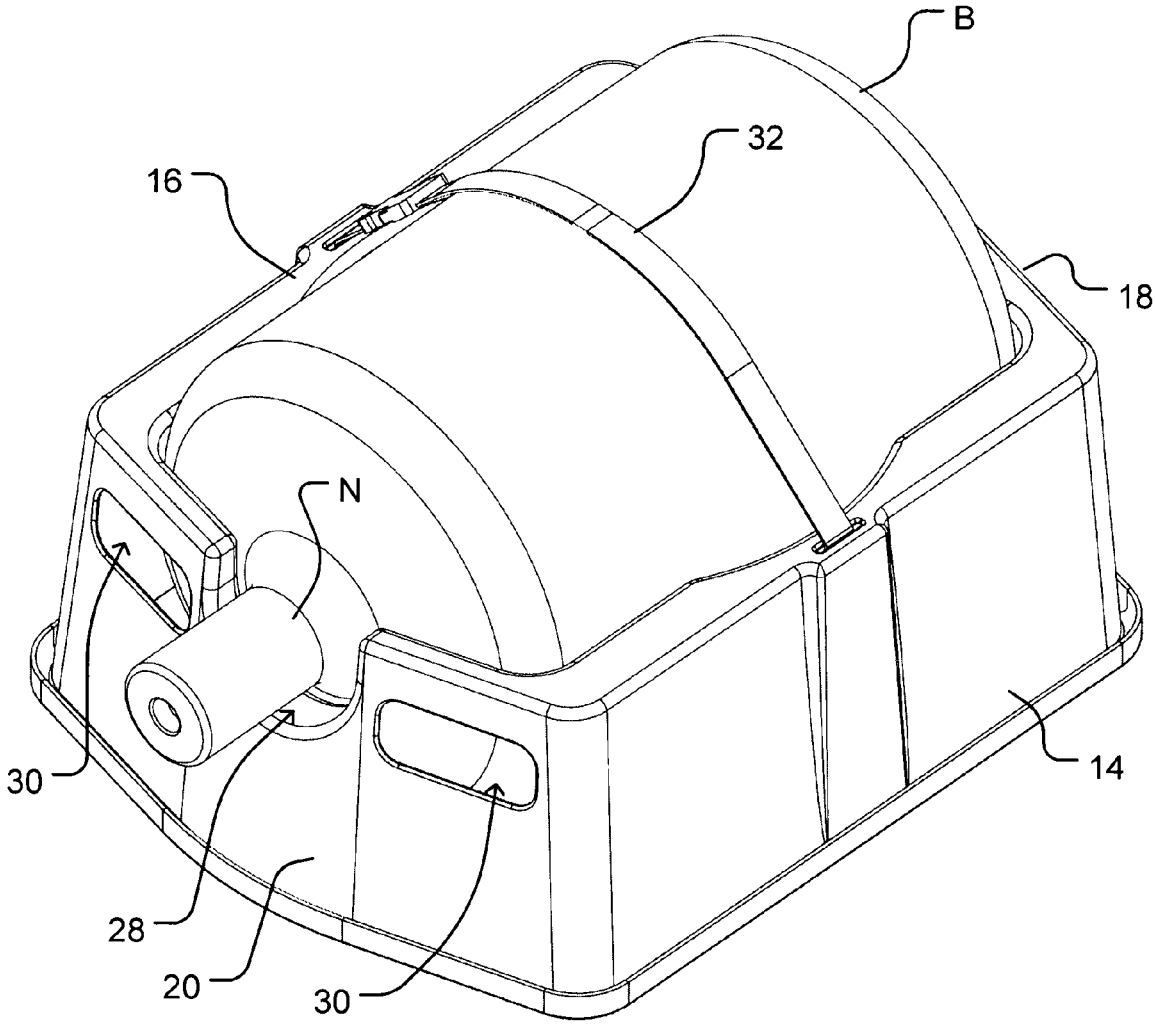
FIG. 6 shows a water cooler bottle secured by the apparatus of FIG. 1.

As best seen in FIGS. 5 and 6, a strap 32 may be provided between side walls 14 and 16 for securing a tank or bottle in apparatus 10. Strap 32 is preferably adjustable in length. Strap 32 may comprise two strap portions 34 and 36 connectable by means of a clip formed by two clip portions 38 and 40.

Strap portions 34 and 36 may be slidably received in slots 42 and 44 defined in upper portions of side walls 14 and 16, respectively. Slots 42 and 44 permit strap portions 34 and 36 be stored within side walls 14 and 16 when not in use. Slots 42 and 44 may be sized to prevent clip portions 38 and 40 from passing therethrough.

In some embodiments, strap 32 may comprise a continuous piece of material, with strap portions 34 and 36 comprising the ends thereof. In such embodiments, base 12 may comprise a strip 46 at the bottom of recess 22 under which the portion of strap 32 between strap portions 34 and 36 may be positioned, such that a container inserted into apparatus 10 does not rest directly on strap 32.

FIG. 5 shows a tank T secured in apparatus 10. A user may secure tank T by placing tank T in apparatus 10 and connecting strap 32 through handle portion H of tank T. Apparatus 10 may then be placed in a vehicle and secured therein by additional straps or the like (not shown) in accordance with any applicable regulations.

FIG. 6 shows a bottle B secured in apparatus 10. A user may secure bottle B by placing bottle B in apparatus 10 with neck portion N positioned in notch 28 and connecting strap 32 around the body of bottle B. Additional straps may not be required for transporting water bottles, but may optionally be provided for securing apparatus 10 in a vehicle.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An apparatus comprising:

a base defining a recess therein, the recess shaped to accommodate a bottom of a standard propane tank;

a pair of side walls extending upwardly from the base, each side wall defining an indentation on the inner surface thereof, the indentations shaped to conform to an outer surface of the tank when the bottom of the tank in the recess; and, a pair of end walls extending upwardly from the base, one of the end walls defining a notch shaped to accommodate a neck of a standard five gallon water cooler bottle lying on a side thereof between the side walls, whereby the apparatus may be used to transport one of the tank and the bottle at a time, and wherein the side walls are spaced apart by a distance insufficient to permit the tank to be placed in a horizontal orientation therebetween such that the tank may only be placed therebetween in an upright orientation at a location of the indentations.

2. An apparatus according to claim 1 wherein a portion of the upper surface of the base and portions of the side walls are shaped to conform to an outer surface of the bottle when the bottle is lying on the side thereof with the neck thereof positioned in the notch in one of the end walls.

3. An apparatus according to claim 1 wherein the side walls extend upwardly from the base by a distance of greater than one third of a height of the tank.

4. An apparatus according to claim 1 wherein the side walls extend upwardly from the base by a distance of greater than 45 percent of a height of a bottle portion of the tank.

5. An apparatus according to claim 1 wherein the side walls extend upwardly from the base by a distance of greater than 60 percent of a diameter of the bottle.

6. An apparatus according to claim 1 comprising handles formed in the end walls.

7. An apparatus according to claim 1 comprising a strap connectable between the side walls for securing one of the tank and the bottle.

8. An apparatus according to claim 7 wherein the strap has an adjustable length.

9. An apparatus according to claim 7 wherein the strap comprises two strap portions connectable by a clip.

10. An apparatus according to claim 1 comprising at least one grip pad area defined in the base for contacting a surface upon which the apparatus rests.

11. An apparatus according to claim 1 wherein the base, side walls and end walls are integrally formed.

12. An apparatus according to claim 11 formed by injection molding.

13. An apparatus according to claim 1 wherein the side walls and end walls are hollow and open along bottoms thereof, such that multiple ones of the apparatus are stackable in a nesting fashion.

* * * * *